United States Patent [19]

Tsutsui et al.

[11] 3,997,810

[45] Dec. 14, 1976

[54] COLOR PICKUP TUBE FACE PLATE WITH OPAQUE SHADING STRIPES OVERLAPPING ADJACENT FILTERS

[75] Inventors: Ken Tsutsui, Tachikawa; Akira Sasano, Kodaira; Toshio Nakano, Tokyo; Haruo Matsumaru, Tokyo; Takeo Nishimura, Tokyo, all of Japan

[73] Assignees: Hitachi, Ltd.; Hitachi Electronics Co., Ltd., both of Japan

[22] Filed: Dec. 4, 1975

[21] Appl. No.: 637,574

[30] Foreign Application Priority Data

Dec. 4, 1974 Japan ..... 49-138423

[52] U.S. Cl. ..... 313/384; 358/44

[51] Int. Cl.[2] ..... H01J 31/00

[58] Field of Search ..... 313/371, 384, 385, 386; 358/44, 46

[56] References Cited

UNITED STATES PATENTS 2,908,835 10/1959 Weimer ..... 313/384

*Primary Examiner*—Robert J. Corcoran

*Attorney, Agent, or Firm*—Craig & Antonelli

[57] ABSTRACT

A color pick-up tube face plate with shading films is disclosed. These shading films are stripe-shaded opaque films, and are formed between the transparent glass plate and the stripe-shaped color filters. As the boundary portions of all the filters are positioned on these shading films, the light incidented around the boundary portions is hindered by the shading films. For this reason, light reflection or scattering around the boundary portions is effectively eliminated, and a pure high quality color picture is obtained.

8 Claims, 10 Drawing Figures

COLOR PICKUP TUBE FACE PLATE WITH OPAQUE SHADING STRIPES OVERLAPPING ADJACENT FILTERS

BACKGROUND OF THE INVENTION

1. Field of the Invention

This invention relates to a color pick-up tube face plate for use in a color television camera composed of one or two pick-up tubes. Usually television cameras of this type are referred to as single-tube color television cameras and two-tube color television cameras. The pick-up tube used in these cameras is referred to as the single pick-up tube for color television and is hereinafter simply called the color pick-up tube.

2. Description of the Prior Art

In a conventional face plate of a color pick-up tube a large number of stripe-shaped red-transmitting, green-transmitting and blue-transmitting filters are periodically distributed adjacent one another on a surface of a transparent substrate, and stripe-shaped transparent conductive films are deposited on these stripe-shaped filters. Furthermore, a photoconductive film is deposited on the whole surface of the stripe-shaped transparent conductive films and exposed portions of the transparent substrate.

For the face plate of a color pick-up tube, two kinds of stripe-shaped filters are used.

One of them is the so called interference filter. This filter is composed of layers, of inorganic films such as cerium oxide, magnesium fluoride, silicon dioxide or titanium oxide.

The other stripe-shaped filter is the so called gelatin filter, and is composed of a gelatin film containing various pigments.

In order to form these stripe-shaped interference filters on the surface of the transparent substrate, the so-caled lift-off method has been employed. This is a method to form suitable films in the desired shapes or patterns on the substrate. According to this method, first of all, soluble matrial films having shapes or patterns inverted to said desired shapes or patterns are deposited on the surface of the substrate. Suitable film is deposited on the whole surface of said substrate containing said soluble material films.

Then, the soluble films are subjected to the dissolution procedure using solvent fit for said soluble material, thereby all of the soluble material films are perfectly removed. Also, as a result of the dissolution of the soluble films, the portion of the suitable films deposited on the soluble films are removed from the substrate, so that the required films having the desired pattern remained on the surface of the substrate.

However, in the lift-off method, removal of undesired portions of the suitable films follows dissolution of the soluble films, so that the edges of the stripe-shaped filters 11, 12, 13 formed on the substrate 1 are roughened remarkably as shown in FIG. 1. Therefore, so long as the conventional lift-off method is employed, it is very difficult to form stripe-shaped interference filters having favorable straight edges.

Although a great part of the light incidented upon the roughened edges of the stripe-shaped filters can transmit these edges, a considerable part of the incident light is reflected or scattered by these roughened edges and consequently the direction of the light is greatly diverted.

On the other hand, the stripe-shaped gelatin filters having the favorable straight edges can be formed very exactly and very easily. However, the light transmitted around the boundary portions of each filter contains two different colors of adjoining stripe-shaped filters. Particularly when the light is incidented upon the face plate at angle, such a color mixture phenomenon takes place very remarkably. For this reason, a favorable picture having good color uniformity and purity cannot be obtained with the conventional color pick-up tube.

SUMMARY OF THE INVENTION

Accordingly, the object of the present invention is to provide an uniquely structured color pick-up tube face plate which can prevent color mixture and exhibit a high quality picture having excellent color uniformity and purity.

To accomplish the above object, the present invention proposes to add stripe-shaped shading films between the transparent substrate and the boundary portions of the adjoining stripe-shaped filters. In this way, the light does not reach the boundary portions of these stripe-shaped filters, and transmitted light having a pure red, green or blue color can be obtained.

DETAILED DESCRIPTION

Figure 1:
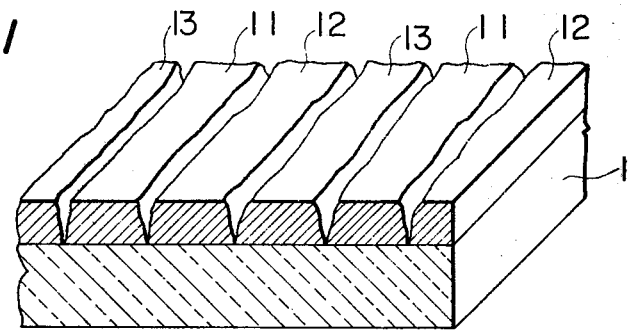
FIG. 1 is a partially schematic illustration showing the roughened edges of the stripe-shaped filters made from suitable materials.
Figure 2:
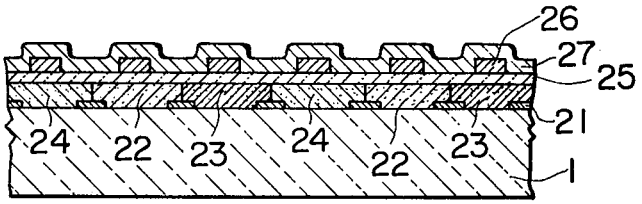
FIG. 2 is a sectional view of one example of a face plate in accordance with the present invention.
Figure 3A:
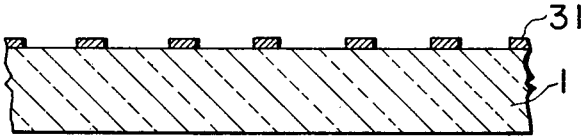
FIG. 3 (*a*), (*b*), )*c*), (*d*), (*e*), (*f*), (*g*) and (*h*) show the step sequence in the process of providing a face plate according to the present invention.
Figure 3B:
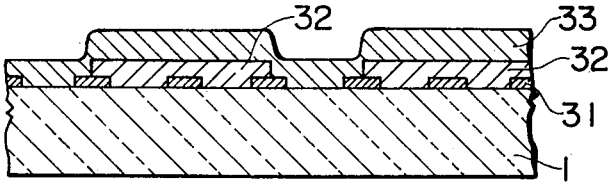
Figure 3C:
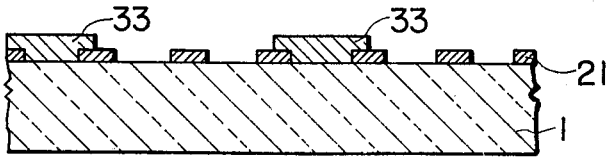
Figure 3D:
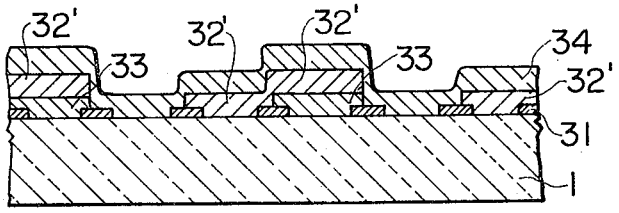
Figure 3E:
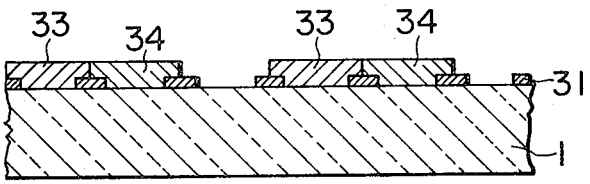
Figure 3F:
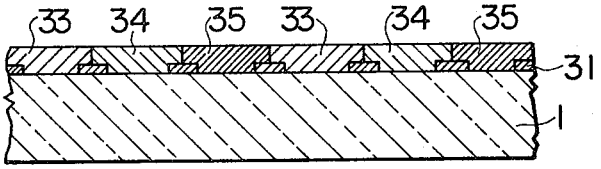
Figure 3G:
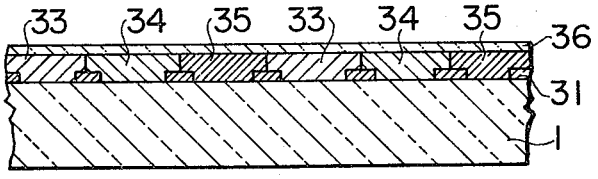
Figure 3H:
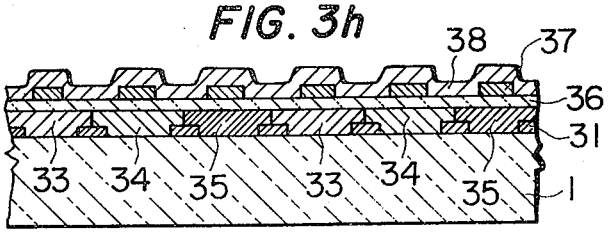

FIG. 2 shows a fractional view of one example of a color pick-up tube face plate according to the present invention. As shown in FIG. 2, in the present invention, the shading films 21 are directly formed on the surface of the glass substrate 1. These shading films 21 are stripe-shaped opaque films, at least one selected from the group of Al, Cr, Ni, Cu, Ti, Mo, Co or SiO having a width of approximately 3$\mu$m and a thickness of approximately 1,000 A. When metals are used for shading films, it is necessary that the shading films 21 be made from metalic materials having a thickness of at least 500 A. If the thickness of the shading films 21 is less than 500 A, a considerable amount of light is transmit through these shading films 21. The amount of light transmitted through the shading films having thickness of 500 A, is about 1–2% of the light incidented upon said shading films. These shading films 21 are formed with at 17 micron meter intervals on the transparent glass substrate 1. The filters 22, 23, 24 are stripe-shaped red, green and blue-transmitting gelatin filters respectively, and the thickness of each filters is about 20 micron meter. As shown in FIG. 2, the shading films 21 are formed between the glass substrate and the boundary portions of the adjoining stripe-shaped filters, such as the red-transmitting filter 22 and the green transmitting filter 23. Therefore, the light incidented around the boundary portions of adjoining filters is hindered by the shading films 21. Also, because the shading films 21 are directly on the transparent substrate 1, not only the light incidented perpendicularly to said portions, but also the light incidented at an angle is similarly hindered by the shading films 21. For this reason, only the light incidented around the centre of the stripe-shaped filters 22, 23, 24 can be transmitted through these filters 22, 23, 24, the glass film 25 and the transparent electrodes 26. Therefore, by scanning the photoconductive film 27 with a electron beam, the electric signals corresponding to the transmitted light having pure red, green and blue colors respectively can be taken out from the transparent electrodes 26. Resultingly, a high quality picture having excellent color uniformity and purity is obtained.

Although an explanation of the case is where the gelatin filters are used it goes without saying that the present invention can be applied in the case where the interference filters are used.

In the case where the interference filters are used, as described above, the edges of each stripe-shaped filter become ragged. Therefore, the effect produced by hindering the undesired mixed color around the boundary portions appears very clearly for the color pick-up tube.

According to the present invention, the structure of a face plate having the stripe-shaped interference filters is substantially the same as the structure of the face plate having the gelatin filters.

FIG. 3 shows another example of the face plate in accordance with the present invention.

Referring to FIG. 3 (*a*), the stripe-shaped chromium films 31 having a thickness of at least 500 A are formed on the desired portions of a surface of the transparent substrate 1.

Next, as shown in FIG. 3 (*b*) the stripe-shaped easily soluble films 32 (hereinafter, called the first reverse films) such as silver films, are formed, and then, a first interference filter film 33, such as a red-transmitting interference filter film, is formed on the whole surfaces of said first reverse films 32, the chromium films 31 and exposed portions of the substrate 1.

The interference filters are formed by piling up the thin inorganic films. For example, the red-transmitting interference filters are deposited in a repeated sequence of titanium oxide film and silicon oxide film in thirteen layers.

Then, said first reverse films 32 are removed by dissolving them with diluted nitric acid, at the same time the portions of the red-transmitting interference filters formed on the first reverse films 32 are removed. Therefore, as shown in FIG. 3 (*c*) stripe-shaped red-transmitting filters 33 remain on the surface of the transparent substrate 1.

The soluble films 32' (the second reverse films) having a pattern inverted to the green transmitting filters are deposited. Then, as shown in FIG. 3 (*d*), the green-transmitting filter films are formed on the whole surface of the red-transmitting filter films 33, shading films 31 and the exposed portions of the substrate 1.

The second reverse films 32' are removed in the same way as the first reverse films. Therefore, the portions of the green-transmitting filter film 34 formed on the second reverse films 32' are removed together with the second reverse films 32' and the stripe-shaped green-transmitting filters 34 are formed adjoining the red-transmitting filters 33 as shown in FIG. 3 (*e*).

The stripe-shaped blue-transmitting filters can be formed in the same way as described above, so that, the stripe-shaped blue-transmitting filters are disposed between the green-transmitting filters 34 and the red-transmitting filters 33 as shown in FIG. 3 (*f*).

It can be seen from FIG. 3 (*f*) that all of the boundary portions of the red, green and blue-transmitting filters are positioned on each shading film respectively. Therefore, the light does not incident upon these boundary portions, and the occurance of scattered or reflected light by the roughened edges of each filter around the boundary portions, is prevented by the shading films 31.

Then, as shown in FIG. 3 (*g*), a transparent glass film 36 is coated on the whole surface of the filters 33, 34, 35.

Finally, transparent electrodes 37 and a photoconductive film 38 are formed. In this way a face plate of a color pick-up tube equipped with stripe-shaped interference filters and shading films and having the structure shown in FIG. 3 (*h*) is formed.

We claim

1. A color pick-up tube face plate comprising, a transparent substrate, stripe-shaped opaque shading films formed on said substrate at desired intervals from each other, stripe-shaped red-transmitting green-transmitting and blue transmitting color filters periodically distributed adjacent one another on the exposed portions of said substrate and said shading films, the boundary portions of said adjoining filters being positoned on said shading films;

a transparent glass film deposited on the whole surface of said filters, transparent electrodes formed on desired portions of said glass film, and a photoconductive layer deposited on the whole surface of the exposed portions of said glass film and said transparent electrodes.

2. The face plate in claim 1, wherein said filters are interference filters.

3. The face plate in claim 1, wherein said filters are gelatin filters.

4. The face plate in claim 1, wherein said shading films are metal films.

5. The face plate in claim 4, wherein said metal is at least one selected from the group of Al, Cr, Cu, Ni, Mo, Ti and Co.

6. The face plate in claim 1, wherein said shading films are opaque inorganic films.

7. The face plate in claim 6, wherein said inorganic material is silicon monoxide.

8. The face plate in claim 4, wherein said metal films have a thickness of at least 500 A.

* * * * *